US005090574A

United States Patent [19]

Hamby

[11] Patent Number: 5,090,574

[45] Date of Patent: Feb. 25, 1992

[54] AUTO TRAMP REMOVAL SYSTEM

[75] Inventor: Michael G. Hamby, Belleville, Ill.

[73] Assignee: T. J. Gundlach Machine Company, Belleville, Ill.

[21] Appl. No.: 569,512

[22] Filed: Aug. 20, 1990

Related U.S. Application Data

[63] Continuation of Ser. No. 250,324, Sep. 27, 1988, abandoned.

[51] Int. Cl.[5] ..... B07C 5/36

[52] U.S. Cl. ..... 209/552; 198/360; 209/606; 209/657; 209/908

[58] Field of Search ..... 209/552, 567, 570, 571, 209/657, 656, 655, 698, 911, 651, 908, 652, 653, 606; 198/360

[56] References Cited

U.S. PATENT DOCUMENTS

| | | | |
|---|---|---|---|
| 2,234,456 | 3/1941 | Schaurte et al. | 209/570 |
| 2,444,751 | 7/1948 | Scott | 209/567 |
| 2,504,731 | 4/1950 | Rose et al. | 209/570 |
| 2,587,686 | 3/1952 | Berry | 209/657 X |
| 2,989,179 | 6/1961 | Woods et al. | 209/657 X |
| 3,040,887 | 6/1962 | Cornelison | 209/586 |
| 4,168,005 | 9/1979 | Sandbank | 209/552 |
| 4,171,262 | 10/1979 | Lattmann et al. | 209/555 |
| 4,254,876 | 3/1981 | Flores-Verdugo et al. | 209/657 X |
| 4,385,700 | 5/1983 | Hodges et al. | 209/539 |
| 4,466,543 | 8/1984 | Zwahlen et al. . | |
| 4,480,753 | 11/1984 | Thomas et al. | 209/546 |
| 4,685,569 | 8/1987 | Osaki et al. | 209/571 |
| 4,753,353 | 6/1988 | Kramer | 209/570 |
| 4,863,040 | 9/1989 | Sandi | 209/570 |

FOREIGN PATENT DOCUMENTS

| | | | |
|---|---|---|---|
| 199412 | 10/1986 | European Pat. Off. | 209/657 |
| 2902901 | 7/1980 | Fed. Rep. of Germany | 209/657 |
| 1076340 | 7/1967 | United Kingdom . | |
| 1315151 | 4/1973 | United Kingdom | 209/655 |
| 1526147 | 9/1978 | United Kingdom . | |

OTHER PUBLICATIONS

Tema, Inc. Cincinnati, Ohio, no date, Tema-Siebtechnik, Automatic Mechanical Sampling Systems (2 sheets).

*Primary Examiner*—Donald T. Hajec
*Attorney, Agent, or Firm*—Cohn, Powell & Hind

[57] ABSTRACT

Apparatus (1) for removing detected tramp material (TM) in a flow of material (M) moving along a primary flow path (P). The tramp material is deflected into one of two deflection paths (P1, P2) which are located of opposite sides of the material flow path. A scoop (29) is responsive to the detection of tramp material to deflect it into one of the deflection paths. The scoop is transported over rails (45, 47) between the deflection paths and across the primary flow path by a carriage (43) driven by a penumatic cylinder and rope and pulley unit (65). An actuator unit (91) repositions the scoop after each traversal of the flow path so it can deflect tramp material on its next traverse of the primary flow path.

17 Claims, 2 Drawing Sheets

FIG. 2.
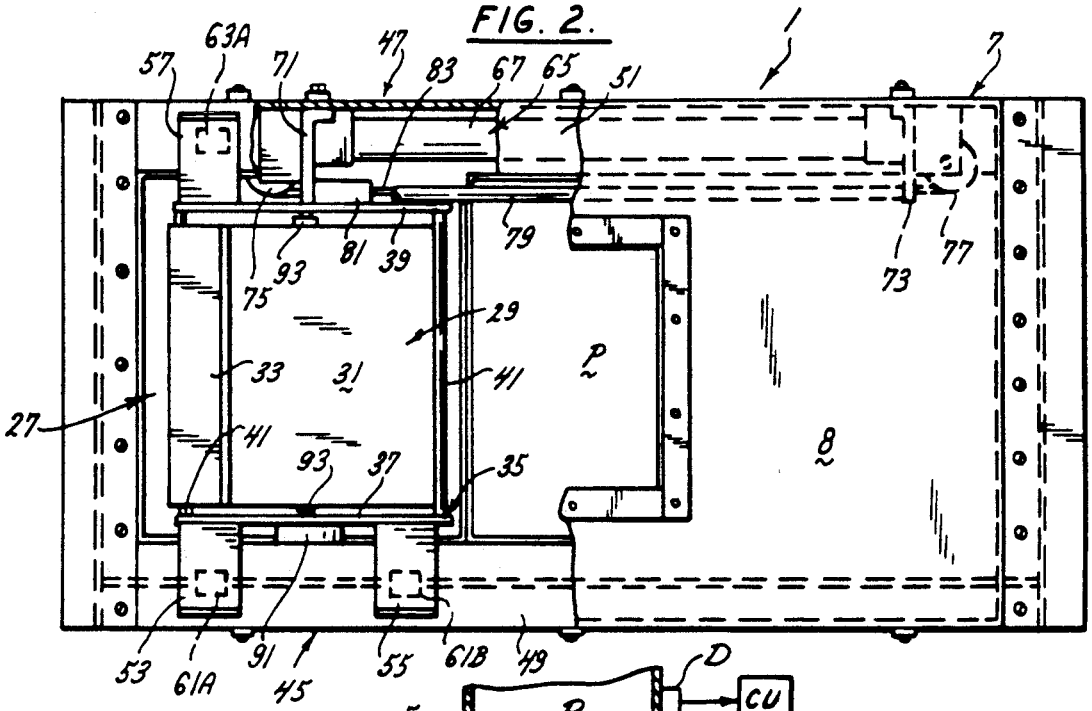
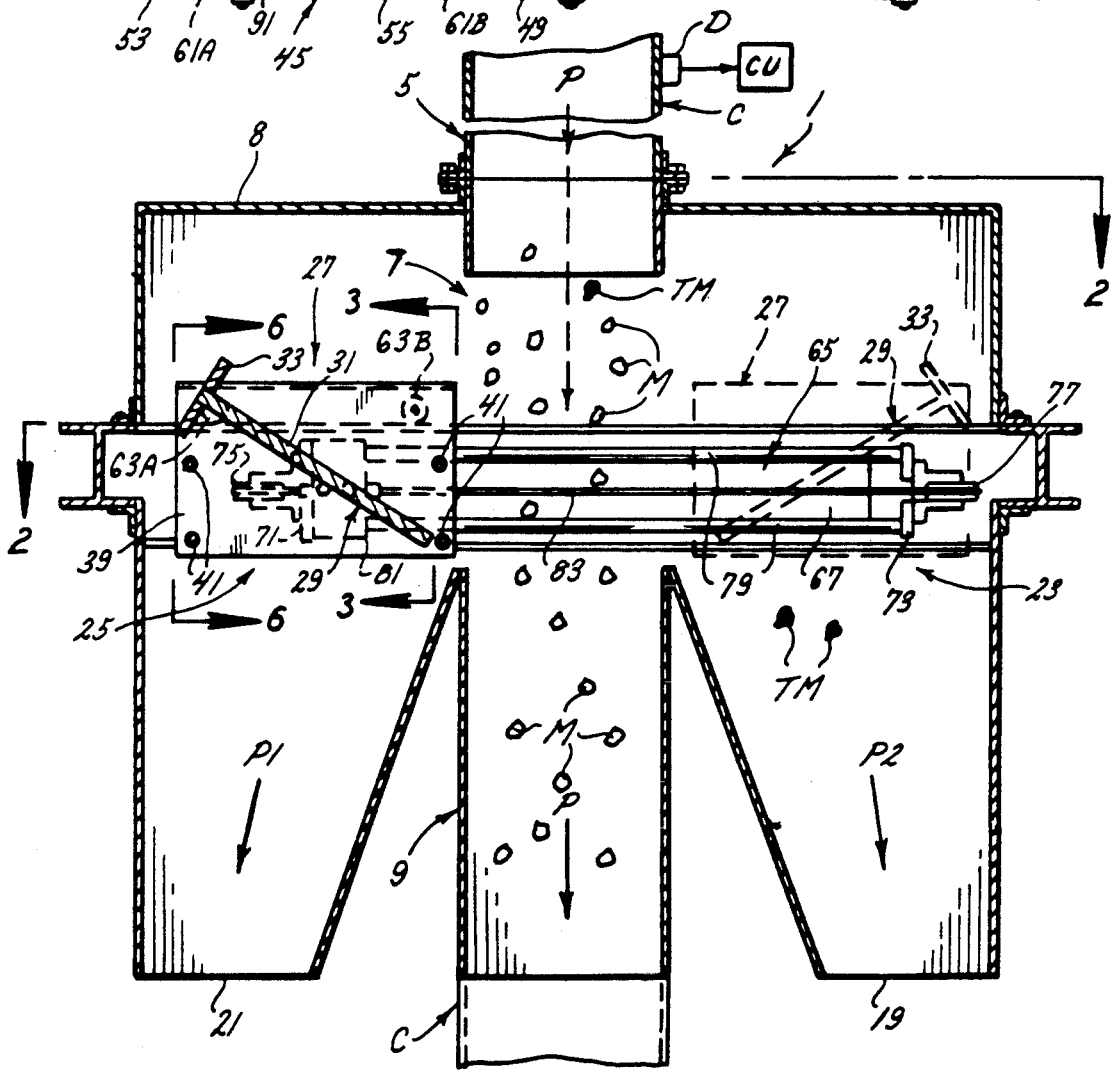
FIG. 1.

AUTO TRAMP REMOVAL SYSTEM

This is a continuation of copending application Ser. No. 07/250,324, filed on Sept. 27, 1988, now abandoned.

BACKGROUND OF THE INVENTION:

This invention relates to material processing equipment and, more particularly, to apparatus for removing tramp metal from material to be processed.

Historically, a major problem with material crushing equipment, whether the equipment be roll-type crushers or cage-type impact crushers, is the presence of tramp material such as tramp iron in the material, typically a mineral such as coal which is being crushed. In a cage-type impact crushing mill, for example, the cages rotate in opposite directions typically at speeds of between 500 and 1000 revolutions per minute (rpm). The feeding of tramp iron between the counter-rotating cages can severely damage the mill resulting in expensive equipment repair and extensive down-time.

Various methods have been employed to try to remove tramp metal including diversion gates such as shown in U.S. Pat. No. 4,480,753 and various types of metal detectors. Metal detectors are often aggravating to operate because the detection of tramp metal usually stops material feed until the tramp metal is located and either removed or tagged for later removal. Only after this is done is feeding restarted. Since tramp metal may be detected numerous times during the course of an operation, the repeated shut downs add to the cost of the crushing operation and become a nuisance. What is required is a removal system which is automatic, so that the operator does not have to locate pieces of tramp metal; effective to remove all tramp metal; yet simple in operation.

This tramp removal apparatus solves the above problems in a manner not revealed in the known prior art.

SUMMARY OF THE INVENTION

The present invention provides apparatus for automatically and rapidly removing tramp metal from a continuous flow of material typically a mineral such as coal; the provision of such apparatus to effectively remove all tramp metal detected in the flow of material; the provision of such apparatus which is continuously operable and does not have to be reset to some starting point each time it operates to remove tramp metal; the provision of such apparatus which is effective to remove tramp metal whether the material is being moved vertically as through a chute or horizontally as along a conveyor; and the provision of such apparatus which is simple in design and easy to install and to operate.

It is an aspect of this invention to provide apparatus for removing tramp material entrained with other material flowing from one point to another, the presence of tramp material being detected during the flow, and the apparatus comprising means defining a primary path through which material including tramp material flows; means defining at least one deflection path to which tramp material can be moved from the primary path, the deflection path being on one side of the primary path; deflection means responsive to the detection of tramp material to deflect said tramp material from the primary path to the deflection path, and carriage means transverse to the primary path for moving the deflection means across the primary path. The carriage means moves the deflection means completely through the primary path without the need for returning the deflection means back to the original position.

It is an aspect of this invention to provide a first deflection path on one side of the primary path and a second deflection path on the other side of the primary path; to provide that the carriage means moves the deflection means between the first and second paths across the primary path, and to provide means for repositioning the deflection means, whereby the deflection means deflects tramp material from the primary path to one deflection path on one traverse of the primary path and to the other deflection path on the next traverse thereof.

It is an aspect of this invention to provide that the primary path defining means includes a chute into which material is loaded at the top and falls, by gravity, to the bottom, and another aspect to provide that the chute primary path has an open section at a point intermediate its length and the means defining the first and second deflection paths include a first deflection chute having an inlet on one side of the open section and a second deflection chute having an inlet on the opposite side of the open section.

Still another aspect of this invention is to provide that the deflection means includes a scoop, and another aspect to provide that the deflection means further includes a frame, said frame having a pair of side members between which the scoop is mounted.

Another aspect of this invention is to provide rail means for the carriage means said rail means extending transversely of the primary path and to provide that the carriage means includes roller means attached to the frame for moving the scoop along the rail means, said rail means, in one aspect of the invention, including a pair of rails extending transversely of the primary path parallel to each other and spaced apart a distance greater than the width of the frame in which the scoop is mounted, and another aspect of the invention to provide that the carriage means further includes a pair of rollers attached to each side member, the rollers rolling along their respective rails to move the scoop across the primary path.

Yet another aspect of this invention is to provide drive means for driving the frame along the rails; another aspect to provide that the drive means comprises rope and pulley means acting on the frame and means operating the rope and pulley means; another aspect to provide that the rope and pulley means includes first and second pulleys located at opposite ends of the rail means and a rope looped between the pulleys; another aspect to provide that the frame includes a sliding member to which both ends of the rope are connected along one reach of the rope.

Still another aspect of this invention is to provide guide means for guiding movement of the frame, and another aspect to provide that the guide means includes at least one rod passing through the sliding member, the rod preventing skewing of the frame as it moves.

Another aspect of this invention is to provide that the scoop is T-shaped, including a short arm and a longer arm, and is pivotally mounted at an angle within the frame, the pivot being at a point intermediate the length of the longer arm.

Yet another aspect of this invention is to provide that the repositioning means includes means for pivoting the scoop each time the frame reaches the end of a traverse whereby the scoop is repositioned to deflect tramp material on each traverse of the primary path, and yet another aspect to provide that the pivoting means includes a pneumatic rotary actuator mounted on the frame and connected to the scoop.

It is an aspect of this invention to provide a tramp metal removal system which is relatively simple to operate, economic to manufacture and highly efficient in operation.

BRIEF DESCRIPTION OF THE DRAWINGS

FIG. 1 is a sectional view of a chute through which material falls and the apparatus of the present invention for deflecting tramp material to a side chute;

FIG. 2 is a partial sectional view taken along line 2—2 in FIG. 1 and illustrating a scoop comprising a portion of the present invention;

Corresponding reference characters indicate corresponding parts throughout the several views of the drawings.

DESCRIPTION OF THE PREFERRED EMBODIMENT

Figure 3:
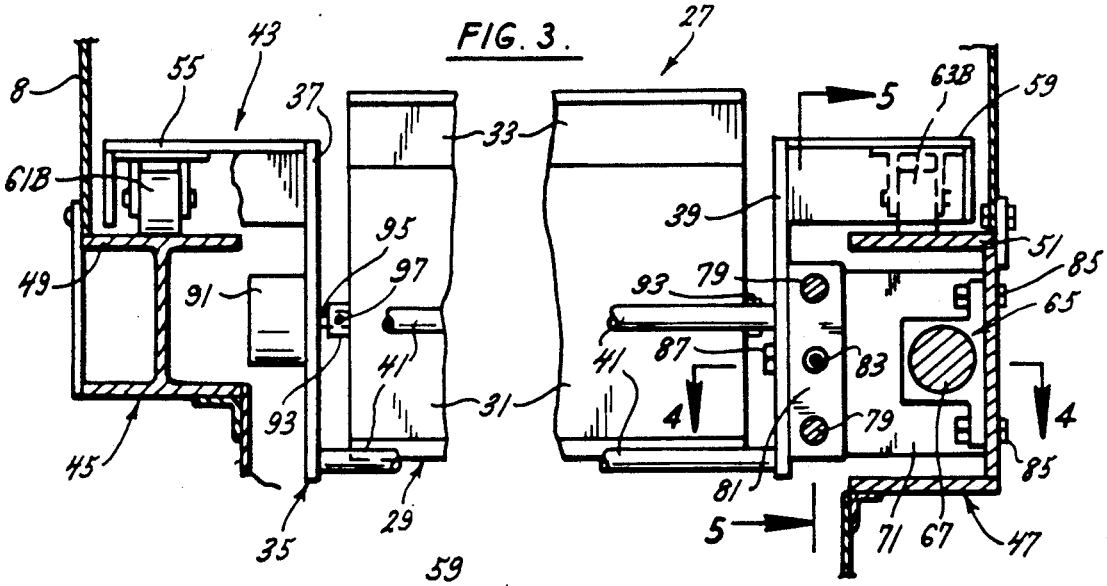
FIG. 3 is a sectional view taken along line 3—3 in FIG. 1.
Figure 5:
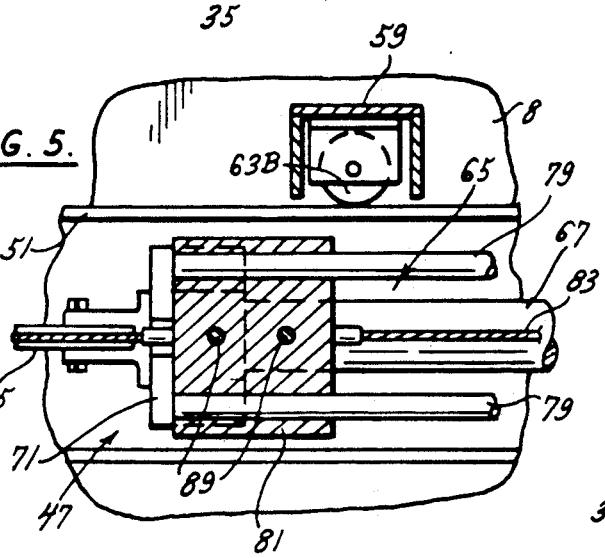
FIGS. 4 and 5 are sectional views taken along lines 4—4 and 5—5 respectively in FIG. 3.
Figure 6:
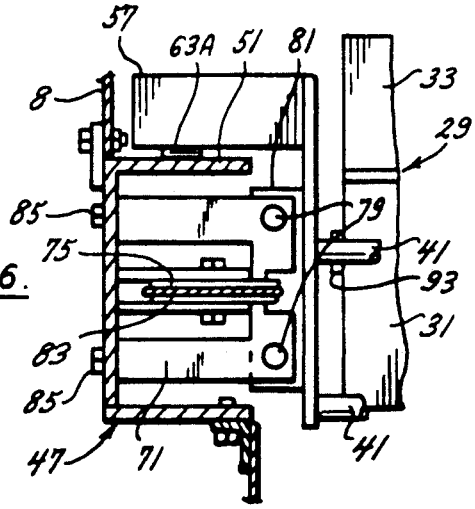
FIG. 6 is a sectional view taken along line 6—6 in FIG. 1.

Referring now by reference numerals to the drawings and first to FIGS. 1 and 2, the apparatus of the present invention for removing tramp material entrained and flowing with other material from one point to another is indicated generally as 1 in the drawings. The material may be flowing vertically as shown in FIG. 1 in which material M is falling by gravity from an upper source (not shown) through a chute C in which tramp material TM is detected by a detector D. Upon detection of the tramp material, an appropriate control signal is provided by the detector to a control unit CU which, in turn, activates apparatus to remove the tramp material from the flow of material to be processed. The detector D and the operation of control unit CU are well-known in the art and form no part of this invention.

Again referring to FIG. 1, apparatus 1 is disposed intermediate the length of the chute C and defines a primary path P through which mineral material M, such as coal including tramp material TM, flows. As shown in FIG. 1, the apparatus includes an upper inlet chute section 5 aligned with the chute C into which the material pours, an intermediate chute section 7, within a removable hood 8, and a lower chute section 9 aligned with the chute C by which the material is delivered to a crushing mill, for example.

Apparatus 1 next includes means defining first and second deflection paths, P1 and P2 respectively, to which tramp material can be moved from the primary path P. Deflection path P1 is on the opposite side of path P from deflection path P2. As shown in FIG. 1, lower chute section 9 is flanked by side chutes 19 and 21, which are on opposite sides of the central section 9. Deflection path P1 is defined by chute 19 and deflection path P2 by chute 21. Intermediate chute section 7 of the apparatus is an open section and provides an inlet 23 to chute 19 and an inlet 25 to opposite chute 21.

A deflection means 27 is provided which is responsive to the detection of tramp material by detector D to deflect the tramp material from path P to one of the deflection paths P1 or P2. The deflection means 27 includes a scoop 29 which is movable from one side of the primary path P to the other, as is described hereinafter. The scoop, which is T-shaped, has a long arm 31 which catches, or scoops up, the tramp material and a short arm 33 which holds the material on the scoop. Scoop 29 is pivotally mounted in a frame 35 having opposed side members 37 and 39, respectively, between which the scoop is mounted. Lateral support bars 41 are used to reinforce the frame 35.

A carriage means 43 is provided to which the frame 35 is mounted and which moves transverse to the primary path P and allows movement of the deflection means across the primary path between the first and second deflection paths P1 and P2 and vice versa. Carriage means 43 is provided with rail means, preferably two rails, 45 and 47 respectively, extending transversely of primary path P. Rails 45 and 47 may be formed in any conventional manner; for example, said rail 45 may be an I-beam, while rail 47 may be a C-shaped beam. C-beam rail 47 is turned on its side with the channel portion of the beam facing left as viewed in FIG. 3. Rails 45 and 47 are parallel to each other and spaced apart a width greater than the width of frame 35 so the frame can be fitted between the rails. At the upper end of frame 35 and extending outwardly from the side members 37 and 39 and at right angles thereto are plates; plates 53 and 55 respectively for side member 37, and plates 57 and 59 for side member 39. The carriage means 43 includes a pair of rollers which are attached to each side member, rollers, 61A and 61B for side member 37, and rollers 63A and 63B for side member 39, said rollers being mounted to the underside of the respective plates 53, 55 and 57, 59 which constitutes part of the carriage means. The rollers sit on top of the respective rails 45 and 47 thus allowing the frame assembly to roll back and forth over the upper horizontal portions 49 and 51 respectively of rails 45 and 47 across and through the primary path P.

Apparatus 1 also includes a drive means which, in the embodiment shown, is provided by a combination pneumatic cylinder and rope pulley unit generally indicated by numeral 65. This unit is of the type sold under the trademark TRAC-TROL manufactured by Greenco and generally referred to as a pneumatic rodless cylinder. In the embodiment shown TRAC-TROL Model T50 is used. As best shown by reference to FIGS. 3 and 4 drive unit 65 includes a pneumatic cylinder 67 and a rope and pulley assembly 69. The drive unit 65 includes mounting brackets 71 and 73, between which the cylinder 67 is connected. Pulleys 75 and 77 are mounted to the brackets 71 and 73 respectively and a pair of guide bars 79 extend between said brackets. A sliding member 81 is mounted to the guide bars 79 and member 81 is attached to opposite ends of the exposed reach of wire rope 83. The drive unit brackets 71 and 73 are attached to C-beam rail 47 by means of bolts 85 and the sliding member 81 is attached to the frame side plate 39 by bolts 87. This arrangement provides that sliding member 81, and therefore carriage 43, moves in response to the supply of air to one side or the other of the cylinder 67.

Figure 4:
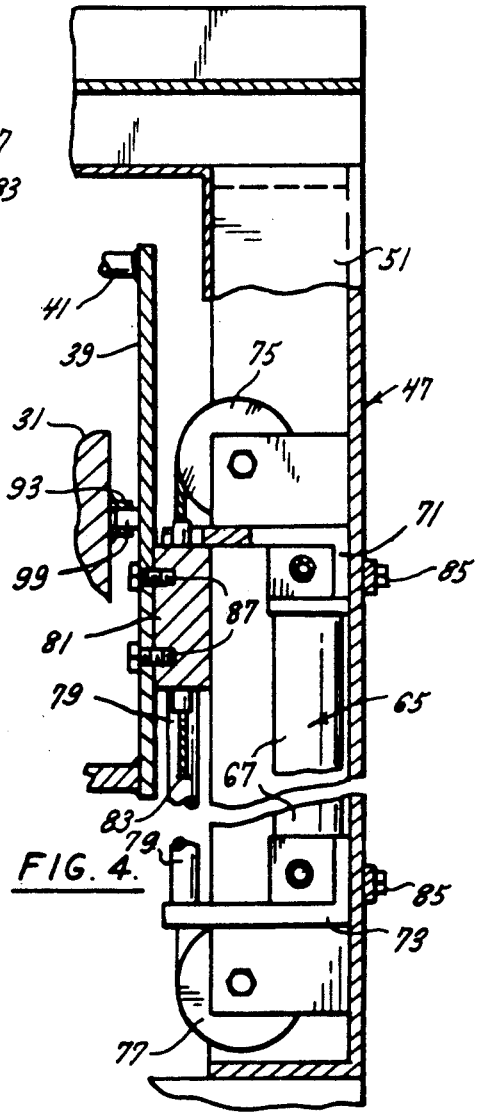

To maximize effective operation of scoop 29, tramp removal apparatus 1 includes an actuator means for repositioning the scoop after each traversal of the primary path P. Scoop 29, as shown in the drawings, is mounted at an angle between the side members, this angle being, for example, 30° from the horizontal. In the embodiment shown, the actuator means is provided by a pneumatic rotary actuator unit 91. As shown in FIG. 3 the actuator unit 91 is mounted to the outer face of side member 37 and is connected to the scoop 29 to rotate said scoop. To this end, and as shown by reference to FIGS. 3 and 4, the scoop 29 includes short sleeves 92 and 93 attached to the longer arm 31, as by welding, and extending outwardly of the scoop at each side respectively. At the actuator side the rotary actuator has a shaft 95 which fits through an opening in side member 37 and is sized to be received in sleeve 92. A lock pin 97 is used to capture the shaft in the sleeve whereby rotation of the shaft causes rotation of the scoop. At the other side, side member 39 includes a stub shaft 99 which is freely received in said sleeve 93.

Operation of the apparatus is such that when tramp material is detected, the pneumatic cylinder 67 is pressurized and the scoop 29 traverses primary path P by virtue of the rope and pulley system. Assuming the starting position shown in FIG. 1, tramp material is deflected into deflector path P2. At the end of the traverse, actuator 91 acts to pivot scoop 29 approximately 120° clockwise to its dashed line position shown in FIG. 1. On the next detection of tramp material, cylinder 67 is pressurized at its opposite end and the rope and pulley assembly pull the scoop back across the path to deflect tramp material into deflection path P1. At the end of the traverse, actuator unit 91 acts to pivot the scoop approximately 120° counter-clockwise to return it to its solid line position shown in FIG. 1. The cycle time for the apparatus is approximately 3 seconds.

Having described the invention in detail, those skilled in the art will appreciate that modifications may be made without departing from its spirit. For example, the apparatus could be modified for use with a conveyor having a horizontal path as opposed to a chute with a vertical path. Also, the drive means and the scoop actuator means are not limited to the pneumatic systems described but can be provided by electrical or other means well within the purview of one skilled in the art. In addition, the material to be processed is not limited to mineral material but could be food products or other products to be processed. Therefore, it is not intended that the scope of the invention be limited to the specific embodiments illustrated and described. Rather, it is intended that the scope of this invention be determined by the appended claims and their equivalents.

I claim as my invention:

1. Apparatus for removing tramp material entrained with other material flowing from one point to another, the presence of tramp material being detected during the flow, and the apparatus comprising:

(a) means defining a primary path through which material including tramp material flows, (b) means defining at least one deflection path to which material including entrained entrained tramp material is moved from the primary path, said one deflection path being initially on one side of the primary path, (c) deflection means to deflect material including said entrained tramp material from the primary path to said one deflection path, and (d) means movable transverse to the primary path responsive to the detection of entrained tramp material for moving the deflection means from said one side completely through the primary path during flow of material between said points and deflecting material including entrained tramp material out of said primary path flow of material without the need for returning said deflection means back to said one side.

2. An apparatus as defined in claim 1, in which:

(e) the primary path means includes a chute into which material is loaded at the top and falls, by gravity, to the bottom.

3. An apparatus as defined in claim 1, in which:

(e) the deflection means includes a scoop.

4. An apparatus as defined in claim 3, in which:

(f) the deflection means further includes a frame in which the scoop is pivotally mounted.

5. The apparatus as defined in claim 4, in which:

(g) the frame comprises a pair of side members between which the scoop is mounted.

6. Apparatus for removing tramp material entrained with other material flowing from one point to another, the presence of tramp material being detected during the flow, and the apparatus comprising:

(a) means defining a primary path through which material including tramp material flows, (b) means defining at least one deflection path to which tramp material is moved from the primary path, said one deflection path being on one side of the primary path, (c) deflection means responsive to the detection of tramp material to deflect said tramp material from the primary path to said one deflection path, and (d) carriage means transverse to the primary path for moving the deflection means across the primary path, (e) the deflection path means including a first deflection path which is provided on one side of the primary path and a second deflection path which is provided on the other side of the primary path, the carriage means moving the deflection means between the first and second paths across the primary path and a repositioning means is provided for repositioning the deflection means whereby the deflection means deflects tramp material from the primary path to one deflection path on one traverse of the primary path and to the other deflection path on the next traverse thereof.

7. An apparatus as defined in claim 6, in which:

(f) the primary path means includes a chute into which material is loaded at the top and falls, by gravity, to the bottom the chute having an open section at a point intermediate its length, and (g) the means defining the first and second deflection paths include a first deflection chute having an inlet on one side of the open section and a second deflection chute having an inlet on the opposite side of the open section, (h) the deflection means includes a scoop, (i) the deflection means further includes a frame in which the scoop is pivotally mounted, (j) the frame comprises a pair of side members between which the scoop is mounted.

8. Apparatus for removing tramp material entrained with other material flowing from one point to another, the presence of tramp material being detected during the flow, and the apparatus comprising:

(a) means defining a primary path through which material including tramp material flows, (b) means defining at least one deflection path to which tramp material is moved from the primary path, said one deflection path being on one side of the primary path, (c) deflection means responsive to the detection of tramp material to deflect said tramp material from the primary path to said one deflection path, (d) carriage means transverse to the primary path for moving the deflection means across the primary path, (e) the deflection means including a scoop, and a frame, the frame comprising a pair of side members between which the scoop is pivotally mounted, and (f) rail means for the carriage means, said rail means extending transversely of the primary path and said carriage means including roller means attached to the frame for moving the scoop along the rail means.

9. The apparatus as defined in claim 8, in which:

(g) the rail means includes a pair of rails extending transversely of the primary path, the rails being parallel to each other and spaced apart a distance greater than the width of the frame in which the scoop is mounted.

10. An apparatus as defined in claim 9, in which:

(h) the roller means includes a pair of rollers attached to each side member, the rollers rolling along their respective rails to move the scoop across the primary path.

11. An apparatus as defined in claim 8, in which:

(g) drive means is provided for driving the frame along the rail means.

12. An apparatus as defined in claim 11, in which:

(h) the drive means includes rope and pulley means acting on the frame and pneumatic means operating the rope and pulley means.

13. An apparatus as defined in claim 12, in which:

(i) the rope and pulley means includes first and second pulleys located at opposite ends of the rail and a rope looped between the pulleys, and the frame includes a sliding member means to which both ends of the rope are connected along one reach of the rope.

14. An apparatus as defined in claim 12, in which:

(i) guide means is provided for guiding movement of the frame, the guide means including at least one rod passing through the sliding member, the rod preventing skewing of the frame as it moves.

15. Apparatus for removing tramp material entrained with other material flowing from one point to another, the presence of tramp material being detected during the flow, and the apparatus comprising:

(a) means defining a primary path through which material including tramp material flows, (b) means defining at least one deflection path to which tramp material is moved from the primary path, said one deflection path being on one side of the primary path, (c) deflection means responsive to the detection of tramp material to deflect said tramp material from the primary path to said one deflection path, and (d) carriage means transverse to the primary path for moving the deflection means across the primary path, (e) the deflection means including a scoop, and a frame in which the scoop is pivotally mounted, (f) the scoop being T-shaped, including a short arm and a longer arm, and a pivot means being provided pivotally mounting the scoop at an angle within the frame, the pivot means being at a point intermediate the length of the longer arm.

16. An apparatus as defined in claim 15, in which:

(i) a repositioning means is provided including means for pivoting the scoop each time the frame reaches the end of a traverse whereby the scoop is positioned to deflect tramp material on each traverse of the primary path.

17. An apparatus as defined in claim 16, in which:

(j) the pivot means includes a pneumatic rotary actuator mounted on the frame and connected to the scoop.

* * * * *